United States Patent [19]

Zenel et al.

[11] 3,932,872

[45] Jan. 13, 1976

[54] CORE DESIGN FOR FLEXIBLE H-SENSOR FOR ELF

[75] Inventors: Joseph A. Zenel, Princeton; William G. McGuffin, Willingboro, both of N.J.; William E. Barnette, Levittown, Pa.

[73] Assignee: The United States of America as represented by the Secretary of the Navy, Washington, D.C.

[22] Filed: Dec. 23, 1974

[21] Appl. No.: 535,259

[52] U.S. Cl. ..... 343/788; 343/895; 174/102 R; 174/108

[51] Int. Cl.[2] ..... H01Q 7/08

[58] Field of Search ..... 343/709, 710, 787, 788, 343/841, 908; 174/102 R, 108

[56] References Cited

UNITED STATES PATENTS 3,068,477 12/1962 Tennyson ..... 343/709

FOREIGN PATENTS OR APPLICATIONS 1,926,259 11/1970 Germany ..... 343/788

*Primary Examiner*—Eli Lieberman

*Attorney, Agent, or Firm*—R. S. Sciascia; P. Schneider; W. T. Ellis

[57] ABSTRACT

A counterwound, magnetic core for a towed-cable, helically wound, ELF antenna comprising a cylindrical, plastic, center insert, with or without a center conductor, with two strips or sets of strips of magnetic material counterwound about it so that a plurality of good-mechanical-contact, strip, crossover points are formed distributed around the circumference of the insert and down its length. An insulating material is then wrapped around these counterwound strips and a conductor helically wound around that. This design, by providing alternate flux paths down the core via the crossover points provides a lower, core reluctance and, when the core is under stress, provides a flux path that avoids the high-stress regions of the core thus reducing the amount of flux that is stress-modulated. Thus a substantial magnetostrictive noise reduction is obtained.

7 Claims, 3 Drawing Figures

CORE DESIGN FOR FLEXIBLE H-SENSOR FOR ELF

FIELD OF THE INVENTION

The invention relates generally to an antenna operable in the extremely low frequency range (ELF) of the electromagnetic energy spectrum and in particular to an inductive-type helix antenna operable in the extremely low frequency range.

PRIOR ART

Radio communication is conducted in a number of frequency bands of the electromagnetic energy spectrum. The lowest of the frequency ranges, commonly designated the extremely low frequency (ELF) range, extends to an upper limit of 3 kilocycles per second. Radio communication in the ELF range possesses several favorable characteristics. Thus the propagation of ground waves is subject to less attenuation, the atmospheric absorption is much less, and the propagation of sky waves is less affected by ionospheric conditions than at higher frequencies. The major advantage to communication in the ELF range is the ability of radio waves at this frequency to penetrate sea water and thereby permit communication with submerged vessels.

A disadvantage of communication at ELF frequencies is that the loop-type antennas normally used for the reception of VLF (3–30 KHZ) are extremely susceptible at ELF (below 3KHZ) to induced, noise voltages resulting from loop motion in the earth's magnetic field.

It has been determined that a distributed loop sensor such as a helical winding wrapped around a cable and either wound back on itself (Pat. application Ser. No. 503 582, filed Sept. 6, 1974, now U.S. Pat. No. 3,913,107) or returned via the center conductor core of the cable substantially reduces this noise susceptibility. As the cable undergoes undulations and vibrations from water turbulence, the stiffness of the cable leads to quasi-sinusoidal deflections of the cable with the net result that for every turn of the loop undergoing twisting motion in one direction, there is another turn undergoing similar twisting motion in the opposite direction. Thus the noise that accumulates from the EMF's generated in each turn tends to be self-cancelling. Furthermore, a desirable figure-of-eight radiation pattern is obtained with this type of configuration.

Such helically wound, cable antennas may be conveniently towed behind a ship or submarine to provide underwater communication.

Since the H-plane component of the electromagnetic radiation is to be detected by the helical winding, a magnetic core may be used to enhance the magnetic field that the helical winding is receiving. A major problem arises in attempting to improve the sensitivity of such magnetic cores since when the effective flux permeability is increased, there is generally a concomitant increase in magnetostrictive self-noise. Furthermore, even if there is no concomitant increase in magnetostrictive noise, there still is a limitation on the volume and weight of the magnetic material that may be used in cable H-sensor design, whether the sensor is intended to be positively buoyant or not.

SUMMARY OF THE INVENTION

Briefly, a magnetic core is disclosed which substantially increases H-wave sensitivity without the normally attendant increase in magnetostrictive self-noise. This magnetic core is formed by two ribbons or sets of ribbons of magnetic material wrapped around an insulator or dielectric insert in a counterwound (one applied in a clockwise manner) fashion. One advantage to this counterwound configuration is that the crossover points in the winding provide a zig-zag path for the flux shorter than that along the normal independent helices, thus reducing the magnetic reluctance of the configuration. But the prime advantage arising from this configuration is that under core flexure these before-mentioned crossover points provide an alternate route for the flux through the magnetic core so that high stress regions of the core may be avoided. Thus the ratio of stress-modulated flux to the total core flux is less than unity, accounting thereby for the reduction of magnetostrictive noise.

OBJECTS OF THE INVENTION

An object of the present invention is to improve the sensitivity of distributed-loop, magnetic antennas.

A further object of the present invention is to increase the sensitivity of the magnetic core of a distributed loop antenna by increasing its effective permeability while reducing its magnetostrictive noise.

A still further object is to provide alternate paths for flux flow in the magnetic core for an antenna so that its reluctance is reduced and so that core regions under high stress may be avoided by the flux.

Other objects, advantages and novel features of the present invention will become apparent from the following detailed description of the invention when considered in conjunction with the accompanying drawing.

DETAILED DESCRIPTION OF THE INVENTION

Figure 1:
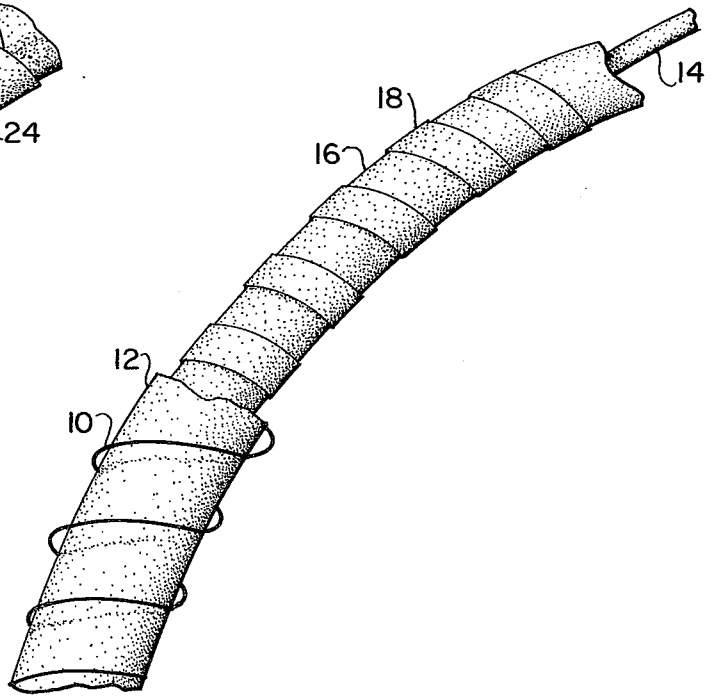
FIG. 1 is a schematic diagram of a simple, parallel-wound, helical core.

Referring now to the drawings, FIG. 1 illustrates a typical cable-type, H-sensor. A conductor 10 is wound around a long, cylindrical insulator 12 to form a series of distributed loops for sensing electromagnetic radiation. When the conductor 10 reaches the end of the insulator 12, it may either be wound back on itself (Pat. application Ser. No. 503,582 now U.S. Pat. No. 3,913,107) or it may be connected to a center conductor 14 in the center of the insulator 12 (shown in FIG. 1) to complete the antenna circuit. Since H-component plane radiation is to be detected by the helical winding, a magnetic core may be inserted in the insulator 12 to enhance the magnetic field that the winding 10 is receiving. In FIG. 1, this magnetic core is shown as a magnetic strip or ribbon 18 wrapped helically around an insulating insert 16 (which may or may not contain a center conductor depending on how the antenna circuit is to be completed). This ribbon-type magnetic core has a small enough volume and weight to meet most design requirements. Typically such magnetic ribbons may be made from a variety of magnetic materials such as, for instance, from materials with the tradenames permalloy and HYMU-80, and the center insert 16 may be an insulated conductor or solid plastic. An insulator 12 then covers this magnetic core 18 and provides a base for the conductor 10.

A basic problem with this type of magnetic-core sensor enhancement is that when the sensor is flexed, a mechanical stress is produced on the core which has the effect of stretching the magnetic strips 10. This stretching causes the material flux permeability (the ability of the material to carry flux) to change. This permeability change modulates the flux (in accordance with these flexures) resulting in the production of magnetostrictive noise. Merely increasing the magnetic permeability of the configuration does not solve this problem since a concomitant increase in magnetostrictive noise is also realized.

This problem is especially acute in high-flex environments such as occur when a cable antenna is towed behind a submarine or a ship.

Figure 2:
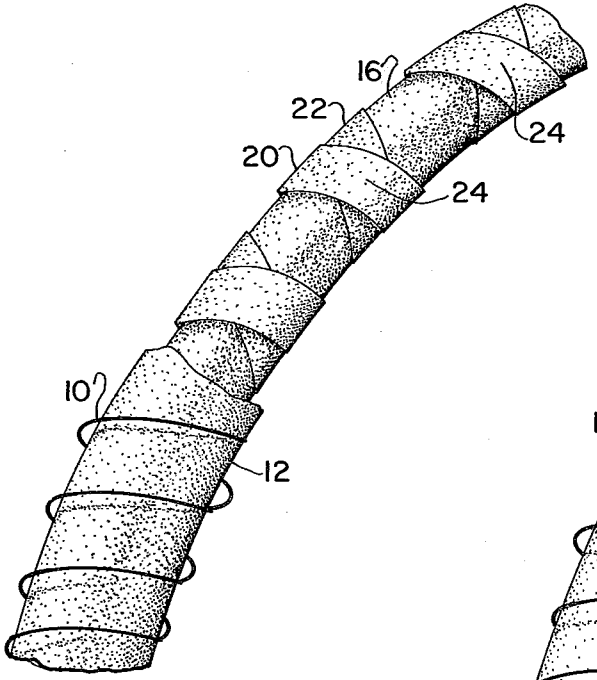
FIG. 2 is a schematic diagram of one embodiment of the counterwound, magnetic core of the present invention.

FIG. 2 shows an embodiment of the magnetic core of the present invention. The magnetic-material core is again in the form of strips or ribbons 20 and 22 thus providing a small-volume, small-weight core. These ribbons 20 and 22 are counterwound, that is, ribbon 20 is applied in a clockwise or "right-hand thread" manner while the ribbon 22 is applied in a counterclockwise or "left-hand thread" manner.

A substantial improvement in core-flux permeability is obtained with an attendant reduction in the flux modulation (which produces magnetostrictive noise) from this counterwound configuration. These improvements are due primarily to the plurality of ribbon crossover points 24 that are formed by this configuration, and which extend down the length of the insulator 16. The crossover points 24 allow a significant fraction of the total flux to cross over at these ribbon overlaps thus providing a much shorter zig-zag path then the normal, independent, helical winding of FIG. 1. This shorter flux path provides a much smaller reluctance (inverse of permeability). Thus a significant permeability improvement is realized under non-stress conditions. Of course, the quantity of flux crossing over to follow the shorter path depends on how good the mechanical contact between the ribbons is at the crossover points 24.

The major advantage of this core configuration is that a significant reduction in magnetostrictive noise produced during flexure of this counterwound configuration is obtained. This reduction is realized as follows. Any bending of the sensor-containing cable places tension in that part of the ribbon cores 20 and 22 occupying the outer region (along the outer bending radius) of the bent cable, while placing little or no compression on that part of the core ribbons 20 and 22 within the inner region (inner bending radius) because these core ribbons are not firmly constrained. Because all of the flux in the simple helical design (FIG. 1) must travel through the region of maximum tension, all of this flux is subject to stress-modulation. In contra distinction, the counterwound design provides an alternate route down the core via the zig-zag path formed by the ribbon 20 and 22 crossovers 24. Thus a certain portion of the flux may avoid the high-stress region of the ribbon core by taking these zig-zag paths, with the result that that flux is not subject to stress-induced flux modulation caused by permeability changes. Hence, in the counterwound design, the ratio of the stress-modulated flux to the total flux is less than unity, resulting in a magnetostrictive noise reduction.

It should be noted here that the turn rates for the two ribbons 20 and 22 should be different so that the crossover points 24 occur at different locations with length (distributed around and down the circumference of the insulator 16) so that the sensor does not have different characteristics as it bends around different planes.

Figure 3:
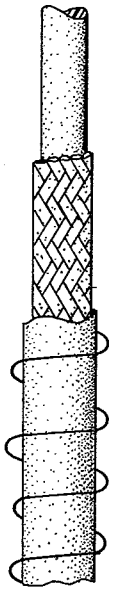
FIG. 3 is a schematic diagram of another embodiment of the present invention.

From the above discussion it can be seen that a completely flexible, cylindrical, magnetic core would be ideal for the reason that a core in which all flux lines travel along paths parallel to the long axis has the least possible reluctance for the material used (shortest path), and a uniform distribution of flux around the circumference of insulator 16 ensures that only a portion of the flux would be affected by bending stress. A counterwound core can be made to approach this ideal by using many ribbons and interweaving them in a braid-like fashion down the core. Such a braided core is shown in FIG. 3.

By way of example only, the following dimensions could be used to construct embodiments of the present invention. The two-ribbon core of FIG. 2 could be formed with a ⅜ inch insert 16 and ¼ inch wide - 6 mils thick magnetic strips. The braided core of FIG. 3 could be formed with a ⅜ inch diameter insert 16 and 10 mils diameter magnetic wire.

Obviously, many modifications and variations of the present invention are possible in light of the above teachings. It is therefore to be understood that, within the scope of the appended claims, the invention may be practiced otherwise than as specifically described.

What is claimed is:

1. A magnetic-core, flexible, H-plane sensor for ELF communications comprising:

small-circumference, longitudinal insert means;

first ribbon means of magnetic material wound in a clockwise fashion down the length of said insert means;

second ribbon means of magnetic material wound in a counterclockwise fashion down the length of said insert means so that said first and second ribbon means cross each other at a plurality of good-mechanical-contact points down the length of said insert means;

insulation means wrapped around said first and second ribbon means down the length of said insert means so that said ribbon means are insulated from the outer environment; and conductor means wrapped around said insulator means down its length to form a distributed-loop sensor.

2. A magnetic-core sensor as defined in claim 1 wherein said insert means is an insulator insert for support purposes only.

3. A magnetic core sensor as defined in claim 1 wherein said insert means comprises a first wire conductor with an electrically insulating layer therearound for insulating said first wire conductor from said first and second ribbon means, and, wherein said conductor means comprises a second wire conductor that is helically wrapped around said insulation means down its length and connected at its end to said first wire conductor to complete the antenna circuit.

4. A magnetic core for a flexible H-plane sensor for ELF communications comprising:

small circumference, longitudinal insert means;

a plurality of first ribbon means of magnetic material;

a plurality of second ribbon means of magnetic material, said plurality of first ribbon means interwoven in a braid-like fashion with said plurality of second ribbon means around and down the length of said insert means so that said first ribbon means are braidedly wound in a clockwise manner while said second ribbon means are braidedly wound in a counterclockwise fashion and a plurality of good-mechanical-contact points are formed at the first and second ribbon cross-over points in the braid down the length of said insert means;

insulation means wrapped around said plurality of braided first and second ribbon means down the length of said insert so that said ribbon means are insulated from the outer environment; and conductor means wrapped around said insulator means down its length to for- a distributed-loop sensor.

5. A method for forming around a long center insert a magnetic-core, flexible, H-plane sensor for ELF communication comprising the steps of:

winding a first conductor of magnetic material around and down the length of said center insert in a clockwise direction;

winding a second conductor of magnetic material around and down the length of said center insert in a counterclockwise direction so that said first and second conductors cross each other at a plurality of good-mechanical-contact points distributed around the circumference and down the length of said center insert;

wrapping an insulating material around the first and second conductor windings down the length of said center insert so that said conductors are insulated from the outer environment; and winding a conductor means around said insulating material down its length to form a distributed-loop sensor.

6. A sensor as in claim 5, wherein said first and second conductors are ribbons.

7. A method for forming a magnetic-core, flexible, H-plane sensor for ELF communication around a long center insert comprising the steps of:

weaving a plurality of ribbons of magnetic material in a braid-like fashion around said center insert so that a plurality of good mechanical contact points between the ribbons are formed around the circumference and down the length of said center insert;

wrapping an insulating material around the braided ribbons down the length of said center insert so that said ribbons are insulated from the outer environment; and winding a conductor means around said insulating material down its length to form a distributed loop sensor.

* * * * *